US010864744B2

(12) United States Patent
Seino

(10) Patent No.: US 10,864,744 B2
(45) Date of Patent: Dec. 15, 2020

(54) LIQUID EJECTING APPARATUS AND CONTROL METHOD OF LIQUID EJECTING APPARATUS

(71) Applicant: SEIKO EPSON CORPORATION, Tokyo (JP)

(72) Inventor: Takeo Seino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/450,345

(22) Filed: Jun. 24, 2019

(65) Prior Publication Data

US 2020/0001615 A1 Jan. 2, 2020

(30) Foreign Application Priority Data

Jun. 27, 2018 (JP) ..... 2018-122133

(51) Int. Cl.

*B41J 2/175* (2006.01)
*B41J 2/165* (2006.01)
*B41J 2/045* (2006.01)

(52) U.S. Cl.

CPC ..... *B41J 2/17566* (2013.01); *B41J 2/04535* (2013.01); *B41J 2/1652* (2013.01); *B41J 2/175* (2013.01); *B41J 2002/17569* (2013.01)

(58) Field of Classification Search

CPC ..... B41J 2/17566; B41J 2/04535; B41J 2002/17569

See application file for complete search history.

(56) References Cited

U.S. PATENT DOCUMENTS 6,517,175 B2 * 2/2003 Kanaya ..... B41J 2/17566 347/19
2005/0024454 A1 2/2005 Hayamizu et al.
2007/0211089 A1 9/2007 Mizuno
2009/0322822 A1 * 12/2009 Kneezel ..... B41J 2/04535 347/17
2017/0189908 A1 * 7/2017 Dzenitis ..... B01L 3/502784

FOREIGN PATENT DOCUMENTS

JP 2003-205603 A 7/2003
JP 2004-114429 A 4/2004
JP 2005-022146 A 1/2005
JP 2007-245361 A 9/2007
JP 2007-301906 A 11/2007

* cited by examiner

*Primary Examiner* — Julian D Huffman
(74) *Attorney, Agent, or Firm* — Workman Nydegger

(57) ABSTRACT

A liquid ejecting apparatus includes: a liquid ejecting head configured to eject liquid contained in a liquid container; a display portion configured to display information; a remaining amount detection portion configured to detect that a remaining amount of the liquid contained in the liquid container becomes less than a threshold value; and a control portion configured to control display of the display portion, in which the control portion causes the display portion to display a calculation remaining amount calculated based on an initial amount of storage of the liquid contained in the liquid container, a total discharge amount of the liquid discharged from the liquid ejecting head, and a correction amount corresponding to a use environment.

9 Claims, 3 Drawing Sheets

LIQUID EJECTING APPARATUS AND CONTROL METHOD OF LIQUID EJECTING APPARATUS

The present application is based on, and claims priority from JP Application Serial Number 2018-122133, filed Jun. 27, 2018, the disclosure of which is hereby incorporated by reference herein in its entirety.

BACKGROUND

1. Technical Field

The present disclosure relates to a liquid ejecting apparatus, such as a printer, or the like, and a control method of a liquid ejecting apparatus.

2. Related Art

For example, as described in JP-A-2005-22146, an ink jet recording apparatus, which is an example of a liquid ejecting apparatus, is provided that ejects ink, which is an example of liquid, from a print head, which is an example of a liquid ejecting head. An ink jet recording apparatus includes a counter that counts the number of ejections of ink from a print head, a sensor, which is an example of a remaining amount detection portion that optically detects the amount of ink, in an ink cartridge, which is an example of a liquid container, and a display, which is an example of a display portion.

In the ink jet recording apparatus, the amount of consumption has been displayed on the display based on a count value of the counter in order to inform the remaining amount of the ink, and near empty has been notified based on the detection result of the sensor.

The amount of usable ink contained in the ink cartridge sometimes changes depending on a use environment. Accordingly, a significant discrepancy might occur between the actual remaining amount of ink when a sensor detects a near empty state and the remaining amount, which is an example of a calculation remaining amount on the display based on a count value. Such a problem might occur not only with an ink jet recording apparatus but also with a liquid ejecting apparatus and a control method of a liquid ejecting apparatus.

SUMMARY

According to an aspect of the present disclosure, there is provided a liquid ejecting apparatus including: a liquid ejecting head configured to eject liquid contained in a liquid container; a display portion configured to display information; a remaining amount detection portion configured to detect that a remaining amount of the liquid contained in the liquid container becomes less than a threshold value; and a control portion configured to control display of the display portion, in which the control portion causes the display portion to display a calculation remaining amount calculated based on an initial amount of storage of the liquid contained in the liquid container, a total discharge amount of the liquid discharged from the liquid ejecting head, and a correction amount corresponding to a use environment.

According to another aspect of the present disclosure, there is provided a control method of a liquid ejecting apparatus including a liquid ejecting head configured to eject liquid contained in a liquid container, a display portion configured to display a calculation remaining amount of the liquid contained in the liquid container, and a remaining amount detection portion configured to detect that a remaining amount of the liquid contained in the liquid container becomes less than a threshold value, the control method including: changing an amount of change of the calculation remaining amount per unit discharge amount in the display portion in accordance with a use environment of the liquid ejecting apparatus.

DESCRIPTION OF EXEMPLARY EMBODIMENTS

In the following, a description will be given of a liquid ejecting apparatus and a control method of a liquid ejecting apparatus according to an embodiment with reference to the drawings. The liquid ejecting apparatus is an ink jet printer that ejects ink, which is an example of liquid, on a medium, for example, a sheet of paper, or the like in order to perform printing.

Figure 1:
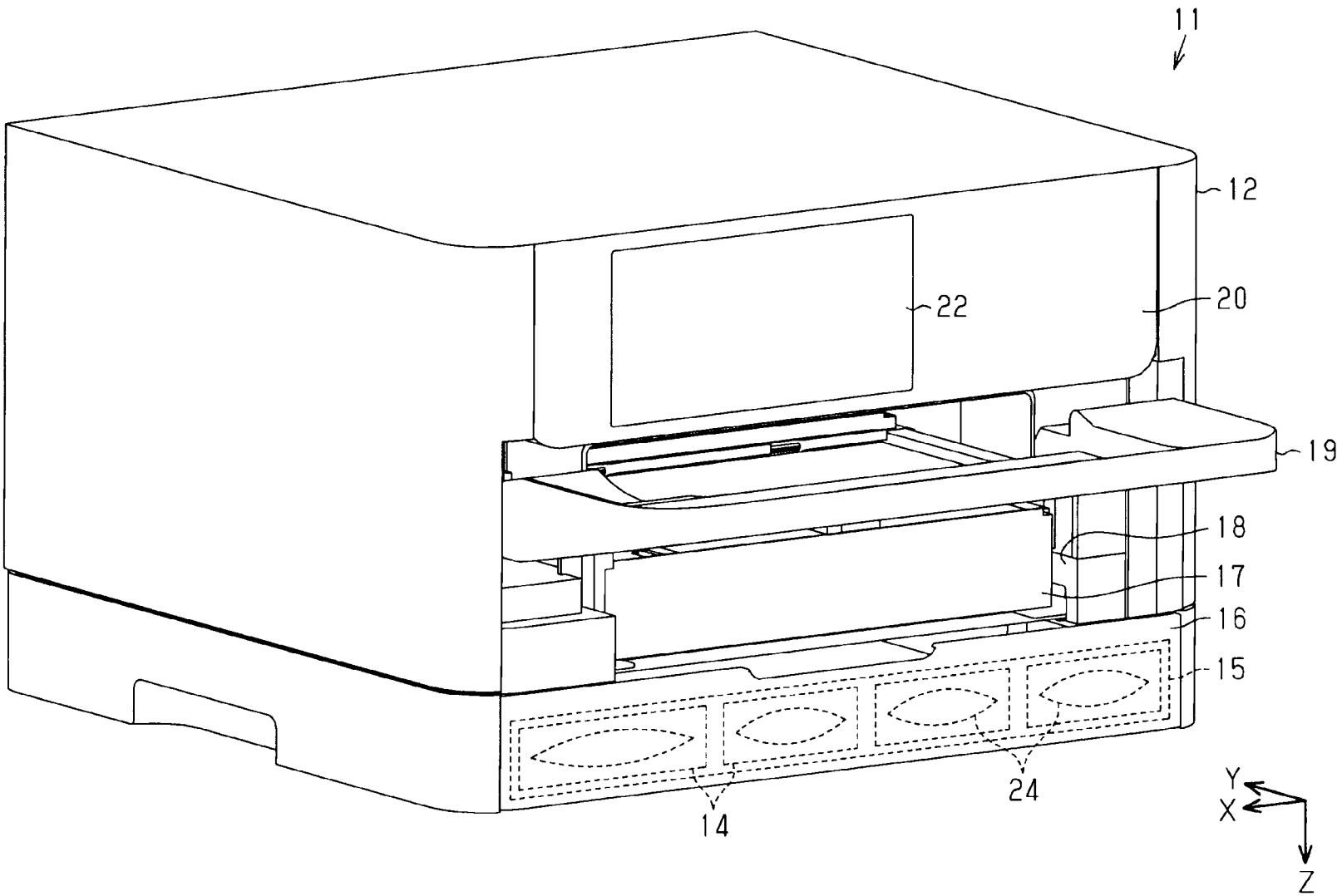
FIG. 1 is a perspective view of a liquid ejecting apparatus according to an embodiment.

As illustrated in FIG. 1, a liquid ejecting apparatus 11 includes a substantially cuboid exterior body 12. In FIG. 1, it is assumed that the liquid ejecting apparatus 11 is placed on a horizontal plane. The direction of gravity is denoted by a Z-axis, and the directions along the plane intersecting the Z-axis are denoted by an X-axis and a Y-axis. When the X-axis, the Y-axis, and the Z-axis are perpendicular to each other, the X-axis and the Y-axis are in the horizontal plane.

It is assumed that a face on which operation on the liquid ejecting apparatus 11 is mainly performed among the side faces of the exterior body 12 is a front face. On the front face of the exterior body 12, a pivotable front cover 16 that covers a mounting portion 15 to which containers 14 are mounted in a detachable manner and a mounting opening 18 to which a medium container 17 capable of containing a medium not illustrated in FIG. 1 are disposed in the order from the bottom side upward. On the upper side of the mounting opening 18, a medium output tray 19 on which a medium is ejected and an operation panel 20 for operating the liquid ejecting apparatus 11 are disposed.

A display portion 22 configured to display various kinds of information is disposed on the operation panel 20. The display portion 22 may include a touch panel that allows operation of the liquid ejecting apparatus 11. An operation button for operating the liquid ejecting apparatus 11 may be disposed on the operation panel 20 separately from the display portion 22.

It is possible to attach one or a plurality of containers 14 to the mounting portion 15. In the containers 14, liquid containers 24 containing liquid are placed in a detachable manner, respectively. The liquid containers 24 are attached to the mounting portion 15 in a placed state in the containers 14, respectively and supply liquid to the liquid ejecting apparatus 11.

When it is possible to attach a plurality of containers 14 to the mounting portion 15, a plurality of liquid containers 24 may contain various kinds of different liquid with each other. The various kinds of different liquid refer to ink having different colors, for example, black, cyan, magenta, yellow, and the like. The containers 14 are also attached to the mounting portion 15 in a detachable manner in a single state in which a liquid container 24 is not held. The containers 14 may be components included in the liquid ejecting apparatus 11.

Figure 2:
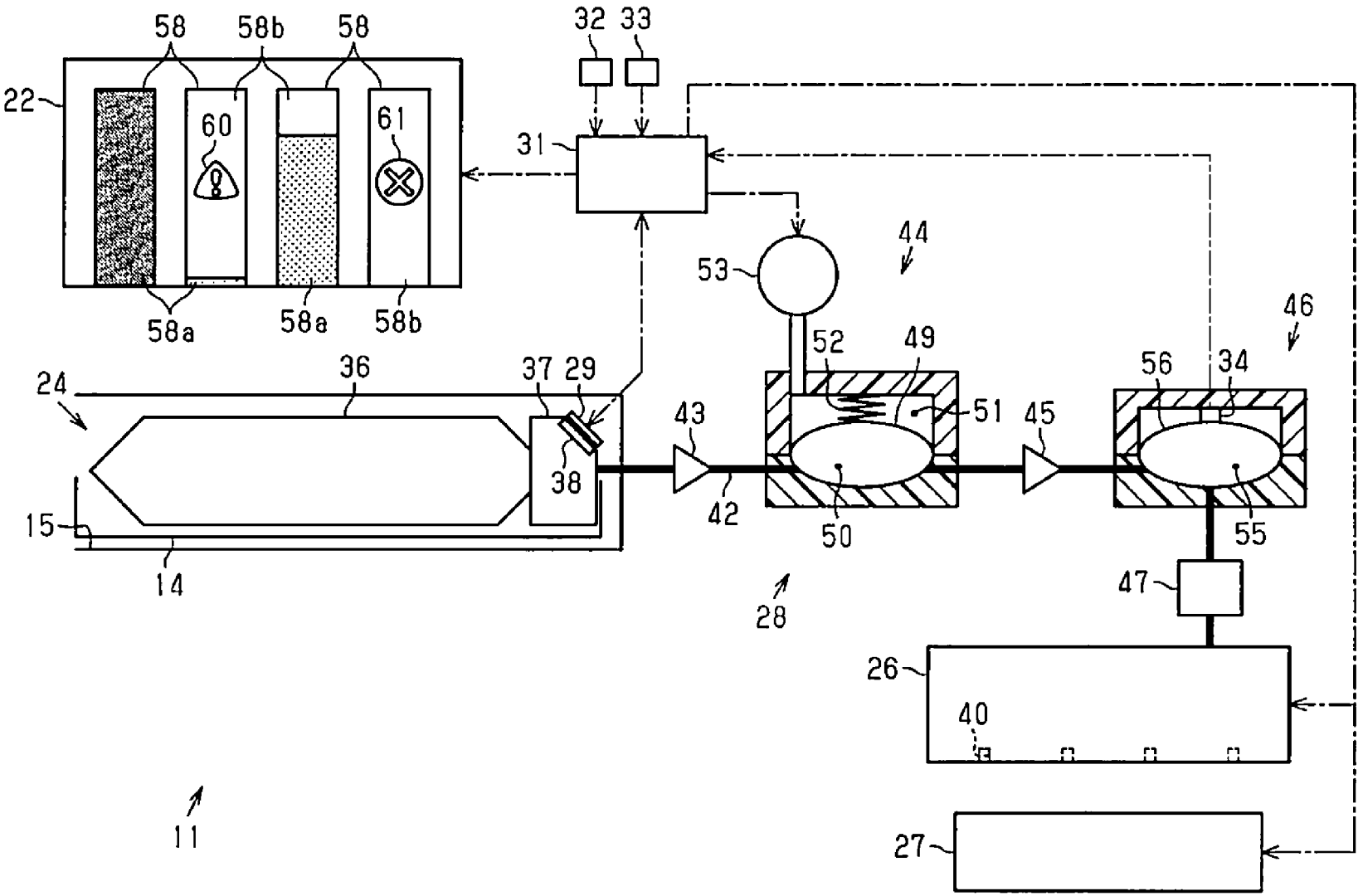
FIG. 2 is a schematic diagram illustrating the internal configuration of the liquid ejecting apparatus.

As illustrated in FIG. 2, the liquid ejecting apparatus 11 includes a liquid ejecting head 26 configured to eject liquid contained in the liquid container 24 and a cleaning portion 27 that cleans the liquid ejecting head 26 by discharging liquid from the liquid ejecting head 26. The liquid ejecting apparatus 11 includes a supply mechanism 28 that supplies liquid from the liquid container 24 to the liquid ejecting head 26 and a coupling terminal 29 that electrically couples with the liquid container 24.

The liquid ejecting apparatus 11 includes a control portion 31 that controls the display of the display portion 22. The control portion 31 includes, for example, a processing circuit including a computer and a memory, and the like. The control portion 31 controls various operations performed by the liquid ejecting apparatus 11 in accordance with a program stored in the memory.

The liquid ejecting apparatus 11 includes an atmospheric pressure measurement portion 32 that measures the atmospheric pressure of a use environment, a temperature measurement portion 33 that measures the temperature of a use environment, and a remaining amount detection portion 34 that detects that the remaining amount of the liquid contained in the liquid container 24 becomes less than a threshold value.

The liquid container 24 includes a bag body 36 that contains liquid, a coupling portion 37 that couples the bag body 36 and the supply mechanism 28, and a circuit substrate 38 disposed on the coupling portion 37. When the liquid container 24 is attached to the mounting portion 15, the coupling portion 37 couples to the supply mechanism 28, and the circuit substrate 38 couples to the coupling terminal 29. The circuit substrate 38 includes a storage unit not illustrated in FIG. 2 and stores information regarding the liquid containers 24, such as the respective kinds and quantities of the liquid, and the like.

A plurality of nozzles 40 that eject liquid are formed on the liquid ejecting head 26. The liquid ejecting head 26 may be a so-called serial head that ejects liquid while moving onto a still medium for printing. The liquid ejecting head 26 may also be a so-called line head that ejects liquid in a still state onto a medium that is being transported for printing.

When a plurality of liquid containers 24 are attachable to the liquid ejecting apparatus 11, the liquid ejecting apparatus 11 includes a plurality of supply mechanisms 28. The plurality of liquid containers 24, the plurality of containers 14, and the plurality of supply mechanisms 28 have the same respective configurations and the same method of supplying liquid. Accordingly, in the present embodiment, a description will be given of one liquid container 24 to be placed in one container 14 and one supply mechanism 28.

The supply mechanism 28 includes a supply channel 42 that couples the liquid container 24 and the liquid ejecting head 26. On the supply channel 42, an upstream side one-way valve 43, a pump 44, a downstream side one-way valve 45, a buffer 46, and a pressure regulating valve 47 are disposed in the order from the upstream side on which the supply channel 42 is coupled to the liquid container 24. The pressure regulating valve 47 adjusts the pressure of the liquid supplied to the liquid ejecting head 26.

The upstream side one-way valve 43 and the downstream side one-way valve 45 allow the liquid in the supply channel 42 to flow from the upstream side to the downstream side and restricts the liquid flow from the downstream side to the upstream side. The upstream side one-way valve 43 is located at an upper stream position than the pump 44 in the supply channel 42 and between the upstream end of the supply channel 42 and the pump 44. The downstream side one-way valve 45 is located at a lower stream position than the pump 44 in the supply channel 42 and between the pump 44 and the buffer 46.

The pump 44 is a diaphragm pump that reciprocates a flexible diaphragm 49 so as to give pressure to the liquid. The pump 44 includes a pump chamber 50 and a negative pressure chamber 51 which are partitioned by a diaphragm 49, and a pressing member 52 disposed in the negative pressure chamber 51 and presses the diaphragm 49 to the side of the pump chamber 50. The pump chamber 50 constitutes a part of the supply channel 42.

The pump 44 includes a power source 53 that reduces the pressure of the negative pressure chamber 51 so as to drive the pump 44. When the power source 53 reduces the pressure of the negative pressure chamber 51, the pump chamber 50 increases its volume against the pressing force of the pressing member 52. Thereby, the pump 44 sucks liquid from the liquid container 24 to the pump chamber 50. When the power source 53 releases the reduction of pressure of the negative pressure chamber 51, the pump chamber 50 reduces its volume by the pressing force of the pressing member 52. Thereby, the pump 44 discharges liquid in the pump chamber 50. The pump 44 alternately drives to suck liquid to the pump chamber 50 and drives to discharge liquid from the pump chamber 50 so as to send liquid from the liquid container 24 side to the liquid ejecting head 26 side.

The buffer 46 includes a storage chamber 55 that stores liquid and a flexible member 56 that constitutes a part of the wall surface of the storage chamber 55. The storage chamber 55 constitutes a part of the supply channel 42. The remaining amount detection portion 34 detects the displacement of the flexible member 56 so as to detect an end state of the liquid container 24. The end state refers to a state in which liquid becomes unable to be supplied from the liquid container 24 to the liquid ejecting head 26.

Specifically, the liquid in the storage chamber 55 is supplied to the liquid ejecting head 26 in accordance with liquid ejection from the liquid ejecting head 26 or liquid discharge from the liquid ejecting head 26 involved in cleaning. Accordingly, the flexible member 56 is deformed so as to reduce the volume of the storage chamber 55. When the pump 44 drives discharging to send liquid to the buffer 46, the flexible member 56 is deformed so as to increase the volume of the storage chamber 55. When the liquid container 24 contains sufficient liquid, the flexible member 56 is deformed so as to change the volume of the storage chamber 55 in accordance with the driving of the pump 44.

The bag body 36 is deformed so as to become deflated as much as the bag body 36 is supplied with liquid. When the remaining amount of the liquid contained in the liquid container 24 becomes less than a threshold value, and the liquid container 24 becomes an end state, liquid is no longer supplied from the liquid container 24. Even when the pump 44 drives discharging, the flexible member 56 keeps the volume of the storage chamber 55 in a small state. The remaining amount detection portion 34 detects the end state when the flexible member 56 is not displaced.

Next, a description will be given of information stored in the circuit substrate 38 and a control method of the liquid ejecting apparatus 11 in which the control portion 31 displays the display portion 22. As illustrated in FIG. 2, the control portion 31 calculates the remaining amount of the liquid contained in the liquid container 24 based on the information stored in the circuit substrate 38 and the control portion 31. The control portion 31 displays the calculated calculation remaining amount on the display portion 22. When the liquid ejecting apparatus 11 is capable of coupling a plurality of liquid containers 24, the control portion 31 may provide a plurality of display areas 58 in the display portion 22, and may calculate the calculation remaining amount per liquid container 24 to display the calculation remaining amount on a corresponding display area 58.

The control portion 31 separates the display area 58 into a remaining amount area 58*a* indicating the calculation remaining amount and a discharge area 58*b* indicating the total discharge amount, and displays the areas. That is to say, the control portion 31 displays the remaining amounts in a bar graph state on the display portion 22.

The circuit substrate 38 stores an initial amount of storage and the total discharge amount. The control portion 31 stores a reference amount, an unusable amount, and a correction amount. The reference amount, the unusable amount, and the correction amount may be stored in the circuit substrate 38.

The initial amount of storage is a liquid quantity contained in the unused liquid container 24. The total discharge amount is the total amount of liquid discharged by the liquid ejecting head 26 from the time when an unused liquid container 24 was coupled. The same amount of liquid discharged by the liquid ejecting head 26 is supplied from the liquid container 24 by the pump 44. Accordingly, the total discharge amount is the liquid quantity supplied from one liquid container 24 to the liquid ejecting head 26.

The control portion 31 counts the number of droplets ejected from the liquid ejecting head 26. The control portion 31 multiplies the counted number by the liquid quantity per one droplet so as to calculate the discharge amount, which is the liquid quantity discharged by the liquid ejecting head 26. When the cleaning portion 27 performs cleaning of the liquid ejecting head 26, the liquid quantity discharged with cleaning becomes the discharge amount. The control portion 31 adds the discharge amount of the liquid ejected from the liquid ejecting head 26 and the discharge amount of the liquid involved in the cleaning to the total discharge amount to update the total discharge amount stored in the circuit substrate 38.

When the liquid contained in the bag body 36 is supplied by the pump 44, the liquid quantity that is suppliable from the liquid container 24 to the liquid ejecting head 26 sometimes changes depending on the use environment of liquid ejecting apparatus 11. For example, the lower the atmospheric pressure of the use environment, the more deteriorates the power of the pump 44 for sucking liquid from the liquid container 24. The flexible bag body 36 becomes more inflexible as the temperature of the use environment is lower.

Accordingly, the lower the atmospheric pressure and the temperature, the larger the unusable amount, which is the remaining liquid quantity in the liquid container 24 without having been used among the liquid contained in the liquid container 24. The unusable amount refers to the remaining liquid quantity in the liquid container 24 in the end state.

Out of the liquid contained in the liquid container 24, a usable amount, which is an available liquid quantity for use becomes smaller as the atmospheric pressure and the temperature becomes lower. A usable amount is a quantity produced by subtracting an unusable amount from an initial amount of storage. That is to say, a usable amount=an initial amount of storage−an unusable amount. An unusable amount and a usable amount also change depending on the size, the shape, the material, and the like of the bag body 36.

In the present embodiment, unusable amounts illustrated in Table 1 were obtained by experiments in advance, and the obtained unusable amounts are stored in the control portion 31. An experiment environment may be determined in any way, for example, the atmospheric pressure may be determined by every 10 hPa or by every 50 hPa, and the temperature may be determined by every 5° C. or by every 10° C., or the like.

TABLE 1

| UNUSABLE AMOUNT | | | | |
|---|---|---|---|---|
| | | ATMOSPHERIC PRESSURE | | |
| | | 900 hPa | 800 hPa | 700 hPa |
| TEMPERATURE | 0° C. | 51 | 57 | 64 |
| | 25° C. | 31 | 38 | 46 |
| | 40° C. | 30 | 38 | 45 |

A reference amount is an amount set based on the initial amount of storage and the maximum unusable amount. A low threshold value is a ratio set in advance and a ratio that serves as a reference to inform a low state indicating that liquid contained in the liquid container 24 becomes little. In the present embodiment, the low threshold value=4%.

A reference amount is an amount that is calculated by the control portion 31 based on the expression: reference amount=initial amount of storage−maximum unusable amount. For example, when the initial amount of storage=1800 g and the maximum unusable amount=64 g, the reference amount=1800−64=1736 g.

The control portion 31 calculates a calculation remaining amount based on an initial amount of liquid contained in the liquid container 24, the total discharge amount of liquid discharged from the liquid ejecting head 26, and a correction amount corresponding to the use environment. Specifically, the control portion 31 calculates a calculation remaining amount based on the expression: the calculation remaining amount=100−the total discharge amount x the amount of change of the calculation remaining amount per unit discharge amount. The control portion 31 calculates the amount of change of the calculation remaining amount per unit discharge amount based on the expression: the amount of change of the calculation remaining amount per unit discharge amount=unit discharge amount/(reference amount+correction amount)×100.

A correction amount is an mount corresponding to an initial amount of storage, the atmospheric pressure of the use environment, and the temperature of the use environment, and is obtained as the difference between the maximum unusable amount of 64 g and the unusable amount at each use environment. Table 2 illustrates the correction amount of the liquid container 24 when the initial amount of storage=1800 g.

TABLE 2

| CORRECTION AMOUNT | | | | |
|---|---|---|---|---|
| | | ATMOSPHERIC PRESSURE | | |
| | | HIGHER THAN 900 hPa | FROM 800 TO 900 hPa | LESS THAN 800 hPa |
| TEMPERATURE | LESS THAN 0° C. | 13 | 7 | 0 |

TABLE 2-continued

| CORRECTION AMOUNT | | | |
|---|---|---|---|
| | ATMOSPHERIC PRESSURE | | |
| | HIGHER THAN 900 hPa | FROM 800 TO 900 hPa | LESS THAN 800 hPa |
| FROM 10 TO 32° C. | 33 | 26 | 18 |
| HIGHER THAN 32° C. | 34 | 26 | 19 |

The amount of change of the calculation remaining amount per unit discharge amount is the ratio of changing the calculation remaining amount for unit discharge amount. The unit discharge amount may be set in any way, such as 1 g, 10 g, 100 g, the discharge amount by printing or cleaning for unit number of times, the discharge amount by printing unit number of sheets, or the like.

Next, a description will be given of the display of the display portion 22 when unit discharge amount=1 g, in a low-temperature and low-pressure environment, namely atmospheric pressure=700 hPa and temperature=0° C., and the initial amount of storage=1800 g. In this environment, the unusable amount=64 g as illustrated in Table 1, the correction amount=0 g, and the usable amount=1800−64=1736 g as illustrated in Table 2.

For example, when an unused liquid container 24 is attached, since the total discharge amount=0 g, the calculation remaining amount=100%. The control portion 31 displays the whole display area 58 as the remaining amount area 58*a*.

When a discharge amount=100 g is discharged from the unused liquid container 24, the total discharge amount=0+100=100 g. The amount of change per unit discharge amount=1/(1736+0)×100≅0.058%, and thus the calculation remaining amount=100−100×0.058≅94.2%.

The control portion 31 displays a lower 94.2% area as the remaining amount area 58*a* out of the display area 58, and an upper 5.8% area as the discharge area 58*b*. When the liquid of a discharge amount=100 g is discharged, the control portion 31 reduces the remaining amount area 58*a* from the calculation remaining amount before discharging the liquid by the amount of change=5.8% per the discharge amount.

Next, a description will be given of the display of the display portion 22 when the unit discharge amount=1 g in a high-temperature and high-pressure environment, namely, atmospheric pressure=900 hPa and temperature=40° C., and the initial amount of storage=1800 g. In this environment, the unusable amount=30 g as illustrated in Table 1, and the correction amount=34 g as illustrated in Table 2.

For example, when the unused liquid container 24 is attached, since the total discharge amount=0 g, the calculation remaining amount=100%. The control portion 31 displays the whole display area 58 as the remaining amount area 58*a*.

When a discharge amount=100 g is discharged from the unused liquid container 24, the total discharge amount=0+100=100 g. The amount of change per unit discharge amount=1/(1736+34)×100≅0.056%, and thus the calculation remaining amount=100−100×0.056≅94.4%.

The control portion 31 displays an approximately lower 94.4% area as the remaining amount area 58*a* out of the lower display area 58 and an upper 5.6% area as the discharge area 58*b*. When the liquid of the discharge amount=100 g is discharged, the control portion 31 reduces the remaining amount area 58*a* from the calculation remaining amount before discharging the liquid by the amount of change=5.6%.

That is to say, the control portion 31 changes the amount of change of the calculation remaining amount per unit discharge amount in accordance with the use environment. The higher the atmospheric pressure, the further the control portion 31 reduced the amount of change of the calculation remaining amount per unit discharge amount. The higher the temperature, the further the control portion 31 reduced the amount of change of the calculation remaining amount per unit discharge amount.

Next, a description will be given of a remaining amount display processing routine in which the control portion 31 displays the remaining amount of the liquid with reference to a flowchart illustrated in FIG. 3. The remaining amount display processing routine is executed at the timing of turning on the power.

Figure 3:
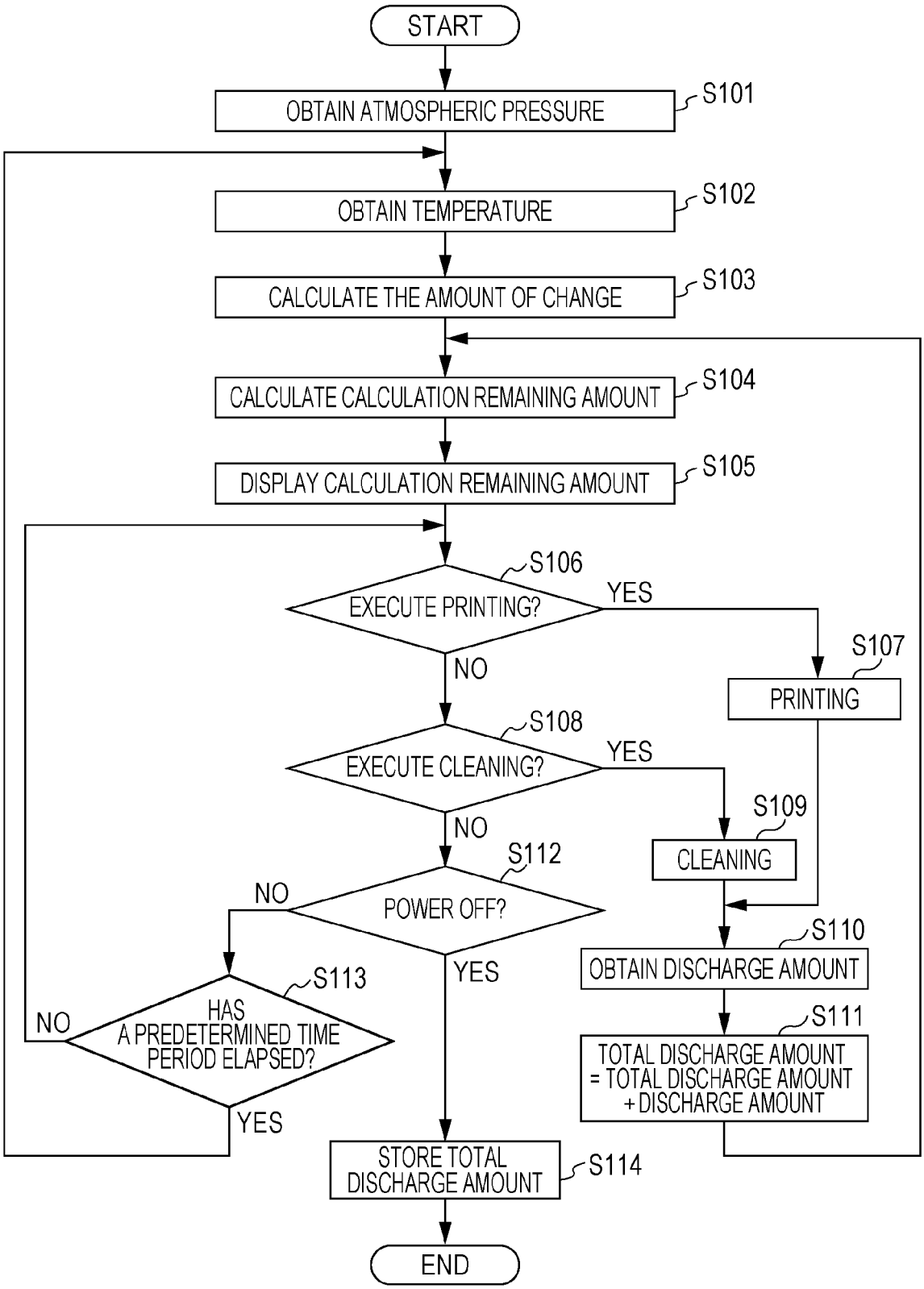
FIG. 3 is a flowchart illustrating a remaining amount display routine.

As illustrated in FIG. 3, in step S101, the control portion 31 obtains atmospheric pressure data measured by the atmospheric pressure measurement portion 32. In step S102, the control portion 31 obtains temperature data measured by the measurement portion 33.

In step S103, the control portion 31 calculates the amount of change of the calculation remaining amount per unit discharge amount. In step S104, the control portion 31 calculates the calculation remaining amount of the liquid contained in the liquid container 24. In step S105, the control portion 31 displays the calculation remaining amount on the display portion 22.

In step S106, the control portion 31 determines whether or not an instruction to perform printing has been input. When printing is performed, the processing proceeds to YES in step S106. In step S107, the control portion 31 performs printing and counts the number of droplets ejected from the nozzle 40 with the printing. When the printing is completed, the processing of the control portion 31 proceeds to step S110.

In step S106, when printing is not performed, the processing proceeds to NO in step S106. In step S108, the control portion 31 determines whether or not to perform cleaning. When cleaning is performed, the processing proceeds to YES in step S108. In step S109, the control portion 31 performs cleaning.

In step S110, the control portion 31 obtains the discharge amount. That is to say, when the processing proceeds from step S107 to step S110, the control portion 31 calculates the discharge amount of the liquid discharged with printing from the count number of droplets, or the like. When the processing proceeds from step S109 to step S110, the control portion 31 calculates the discharge amount of the liquid discharged with cleaning from the type of the cleaning, or the like.

In step S111, the control portion 31 adds the obtained discharge amount to the total discharge amount so as to update the total discharge amount. The processing of the control portion 31 proceeds to step S104. In step S104, the control portion 31 calculates the calculation remaining amount based on the updated total discharge amount. In step S105, the control portion 31 displays the calculated calculation remaining amount on the display portion 22.

In step S108, when cleaning is not performed, the processing proceeds to NO in step S108. In step S112, the control portion 31 determines whether or not an instruction for turning off the power to the liquid ejecting apparatus 11 has been input.

In step S112, when the power is not turned off, the processing proceeds to NO in step S112. In step S113, the control portion 31 determines whether or not a predetermined time period has elapsed. When the predetermined time period has not elapsed, the processing proceeds to NO in step S113. The processing of the control portion 31 proceeds to step S106. When the predetermined time period has elapsed, the processing proceeds to YES in step S113. The processing of the control portion 31 proceeds to step S102.

In step S112, when the power is turned off, the processing proceeds to YES in step S112. In step S114, the control portion 31 stores the total discharge amount updated in step S111 in the circuit substrate 38 and terminates the remaining amount display processing routine.

A description will be given of the operation of the present embodiment.

The control portion 31 obtains the atmospheric pressure and the temperature of the use environment at the time of turning on the power to the liquid ejecting apparatus 11 and changes the amount of change of the calculation remaining amount per unit discharge amount. The control portion 31 obtains temperature data and changes the amount of change of the calculation remaining amount per unit discharge amount every time a predetermined time period elapses in the power-on state. The control portion 31 calculates the calculation remaining amount and displays the calculation remaining amount on the display portion 22 at the time of turning on the power, every time a predetermined time period elapses in the power-on state, and every time printing or cleaning is performed.

As illustrated in FIG. 2, when the calculation remaining amount=a low threshold value, the control portion 31 displays a low mark 60 on the display portion 22. In the present embodiment, the control portion 31 determines a low threshold value of 4% to be the remaining amount area 58*a* out of the display area 58 and displays the low mark 60. That is to say, when the low mark 60 is displayed, the ratio of the remaining amount area 58*a* to the display area 58 becomes a fixed value regardless of the use environment.

When the calculation remaining amount becomes less than 0%, the control portion 31 continues to display the low mark 60 in the display area 58. Further, when the total discharge amount changes and the remaining amount detection portion 34 detects the end state, the control portion 31 displays the end mark 61 in the display portion 22 so as to correspond to the display area 58 of the liquid container 24 that becomes the end state.

A description will be given of the advantages of the present embodiment.

1. The control portion 31 adds a correction amount corresponding to the use environment to the calculation remaining amount and displays the calculation remaining amount in the display portion 22. Accordingly, it is possible to reduce a discrepancy between the actual remaining amount of the liquid contained in the liquid container 24 and the calculation remaining amount displayed in the display portion 22.

2. For example, when the amount of change per unit discharge amount is fixed, the size of the display area 58 in which the calculation remaining amount has to be changed in accordance with the use environment. However, when the size of the display area 58 is changed, it might give a user the impression that the initial amount of storage has changed. On that point, the control portion 31 changes the amount of change of the calculation remaining amount per unit discharge amount in accordance with the use environment. Accordingly, it is possible to display the calculation remaining amount corresponding to the use environment while keeping the size of the display area 58 for displaying the calculation remaining amount fixed.

3. For example, some of the liquid ejecting apparatuses 11 supply the liquid contained in the liquid container 24 to the liquid ejecting head 26 using the pump 44. In some of the pumps 44, the suction performance for sucking the liquid from the liquid container 24 changes in accordance with the atmospheric pressure of the use environment. On that point, the control portion 31 calculates the calculation remaining amount based on the correction amount corresponding to the atmospheric pressure. Accordingly, it is possible to reduce a discrepancy between the actual remaining amount of the liquid contained in the liquid container 24 and the calculation remaining amount displayed in the display portion 22.

4. When the atmospheric pressure of the use environment is low, the pump 44 that supplies liquid is likely to have a lower suction performance than when the atmospheric pressure is high. That is to say, the usable liquid quantity out of the liquid contained in the liquid container 24 tends to increase as the atmospheric pressure is high. Accordingly, by reducing the amount of change of the calculation remaining amount per unit discharge amount as the atmospheric pressure becomes higher, it is possible to reduce a discrepancy between the actual remaining amount of the liquid contained in the liquid container 24 and the calculation remaining amount displayed in the display portion 22.

5. For example, some of the liquid containers 24 contain liquid in a flexible bag body 36. The bag body 36 changes its flexibility with temperature. On that point, since the control portion 31 calculates the calculation remaining amount based on the correction amount corresponding to a temperature, it is possible to reduce a discrepancy between the actual remaining amount of the liquid contained in the liquid container 24 and the calculation remaining amount displayed in the display portion 22.

6. The bag body 36 becomes more inflexible when the temperature of the use environment is lower than when the temperature is higher. That is to say, out of the liquid contained in the liquid container 24, the usable liquid quantity tends to increase as the temperature of the use environment is higher. Accordingly, by reducing the amount of change of the calculation remaining amount per unit discharge amount as the temperature becomes higher, it is possible to reduce a discrepancy between the actual remaining amount of the liquid contained in the liquid container 24 and the calculation remaining amount displayed in the display portion 22.

7. The control portion 31 changes the amount of change of the calculation remaining amount per unit discharge amount in accordance with the use environment at the time of turning on the power. Accordingly, it is possible to display the calculation remaining amount in accordance with the use environment at the time of using the liquid ejecting apparatus 11.

8. Every time a predetermined time period elapses in the power-on state, the control portion 31 changes the amount of change of the calculation remaining amount per unit discharge amount in accordance with the use environment. Accordingly, when the use environment has changed in a state of using the liquid ejecting apparatus 11, it is possible to display the calculation remaining amount to suit the use environment.

9. The control portion 31 changes the amount of change of the calculation remaining amount per unit discharge amount displayed in the display portion 22 in accordance with the use environment of the liquid ejecting apparatus 11. Accordingly, it is possible to reduce a discrepancy between the actual remaining amount of the liquid contained in the liquid container 24 and the calculation remaining amount displayed in the display portion 22.

10. As the atmospheric pressure of the use environment becomes higher, the amount of change of the calculation remaining amount per unit discharge amount is further reduced. Accordingly, it is possible to reduce a discrepancy between the actual remaining amount of the liquid contained in the liquid container 24 and the calculation remaining amount displayed in the display portion 22.

11. As the temperature of the use environment becomes higher, the amount of change of the calculation remaining amount per unit discharge amount is further reduced. Accordingly, it is possible to reduce a discrepancy between the actual remaining amount of the liquid contained in the liquid container 24 and the calculation remaining amount displayed in the display portion 22.

It is possible to change the present embodiment as follows and to carry out the present embodiment. It is possible to combine the present embodiments and the following variations in the range that does not cause technical inconsistencies. The control portion 31 may display the calculation remaining amount by a numeric value. The control portion 31 may display the calculation remaining amount by a pie chart, a line graph, or the like.

A plurality of liquid containers 24 having different initial amount of storages may be attachable to the liquid ejecting apparatus 11. The size of the display area 58 may be changed in accordance with the initial amount of storage. For example, a large-sized liquid container 24 having an initial amount of storage=1800 g and a small-sized liquid container 24 having an initial amount of storage=200 g may be attachable to the mounting portion 15 of the liquid ejecting apparatus 11. In this case, the size of the display area 58 corresponding to the large-sized liquid container 24 may be larger than the size of the display area 58 corresponding to the small-sized liquid container 24.

The control portion 31 may update the display of the display portion 22 at the timing when the unit discharge amount is discharged.

The control portion 31 may determine the discharge amount corresponding to an amount of change=1% as a unit discharge amount, may decrease the remaining amount area 58*a* by 1% every time the unit discharge amount of liquid is discharged, and may display the result.

The control portion 31 may update the display of the display portion 22 at the timing of having printed a unit number of sheets.

The control portion 31 may update the display of the display portion 22 at the timing of having performed cleaning and printing a plurality of times.

The control portion 31 may change the amount of change of the calculation remaining amount per unit discharge amount at the timing when the liquid ejecting apparatus 11 is installed. The control portion 31 may change the amount of change at the timing when instructed by a user. The control portion 31 may change the amount of change at least one of the timings when the liquid ejecting apparatus 11 is installed, when instructed by a user, when the power is turned on, and when a predetermined time period has elapsed in a power-on state.

When it is not possible to obtain the temperature in a use environment, the control portion 31 may calculate the amount of change and the calculation remaining amount based on an assumed minimum temperature. When it is not possible to obtain the atmospheric pressure in a use environment, the control portion 31 may calculate the amount of change and the calculation remaining amount based on an assumed minimum atmospheric pressure. Based on the minimum temperature or the minimum atmospheric pressure, it is possible to reduce the risk of becoming the end state before displaying the low mark 60.

After the calculation remaining amount becomes less than a low threshold value and the low mark 60 is displayed, when the use environment has changed, and the calculation remaining amount becomes higher than a low threshold value, the control portion 31 may display the low mark 60 or delete the low mark 60 until the power is turned off.

When the power is turned off in the state of displaying the low mark 60, the use environment has changed, and the calculation remaining amount becomes higher than a low threshold value until the power is turned on, the control portion 31 may display the low mark 60 or delete the low mark 60.

The remaining amount detection portion 34 may detect the low state. The remaining amount detection portion 34 may detect that the remaining amount of the liquid contained in the liquid container 24 becomes less than a low threshold value, which is an example of a threshold value.

In the liquid ejecting apparatus 11, a liquid quantity per one droplet ejected from the liquid ejecting head 26 sometimes varies depending on an individual head. Accordingly, the control portion 31 may obtain the difference between the calculation remaining amount from the time when an unused liquid container 24 is attached to the time of becoming the end state and the usable amount, and may correct the liquid quantity per one droplet so as to reduce the difference.

The control portion 31 may calculate the calculation remaining amount without adding a correction amount and display the calculation remaining amount until the remaining amount contained in the liquid container 24 continues to be large. For example, when the total discharge amount is equal to or larger than half the initial amount of storage, the control portion 31 may calculate the calculation remaining amount by the expression: the calculation remaining amount=(the usable amount−the total discharge amount)/the usable amount×100, or may calculate the calculation remaining amount by the expression: the calculation remaining amount=(the initial amount of storage−the total discharge amount)/the initial amount of storage×100.

The liquid ejecting apparatus 11 may have the configuration of not including the atmospheric pressure measurement portion 32. An atmospheric pressure may be input by a user. A user may input the information, such as altitude, city name, area, postal code, and the like. The control portion 31 may store an atmospheric pressure so as to correspond to the input information.

The liquid ejecting apparatus 11 may have a configuration not including the temperature measurement portion 33. A temperature may be input by a user. The calculation remaining amount may be calculated based on a temperature measured by a thermistor installed in the control portion 31 or the liquid ejecting head 26.

The control portion 31 may change the amount of change of the calculation remaining amount based on the correction amount corresponding to either the temperature or the atmospheric pressure of the use environment. For example, when the liquid contained in a hard storage chamber is sucked by the pump 44 and is supplied to the liquid ejecting head 26, the correction amount changes depending on the atmospheric pressure of the use environment. Accordingly, the control portion 31 may change the amount of change of the calculation remaining amount based on the correction amount corresponding to the atmospheric pressure of the use environment. For example, when the liquid contained in the liquid container 24 is supplied to the liquid ejecting head 26 at the hydraulic head, the correction amount changes depending on the temperature of the use environment. Accordingly, the control portion 31 may change the amount of change of the calculation remaining amount based on the correction amount corresponding to the temperature of the use environment.

The control portion 31 may change the size of the display area 58 in accordance with the use environment. The control portion 31 may keep the amount of change of the calculation remaining amount per unit discharge amount at a fixed value regardless of the use environment.

The remaining amount detection portion 34 may detect that the remaining amount of the liquid contained in the liquid container 24 becomes less than a threshold value by detecting the deformation of the bag body 36.

The liquid ejecting apparatus 11 may be a liquid ejecting apparatus that ejects or discharges liquid other than ink. It is assumed that the state of the liquid discharged from the liquid ejecting apparatus as very little droplets includes a granular state, a teardrop-shaped state, and a filament state leaving a trail. The liquid mentioned here ought to be a material ejectable from a liquid ejecting apparatus. For example, the liquid may be a substance which is a liquid state and includes a high-viscosity or low-viscosity liquid material, and fluid substances, such as sol, gel solution, the other inorganic solvents, organic solvents, solutions, liquid resins, liquid metals, and metal melts. It is assumed that the liquid includes not only a liquid as one state of a substance but also particles of functional materials including solid matters that are dissolved, dispersed, mixed, or the like, such as pigments, metal particles, and the like. A representative example of the liquid includes ink described in the embodiments, liquid crystal, and the like. Here, ink refers to general water-based ink, oil-based ink, and various liquid compositions, such as gel ink, hot melt ink, and the like. Specific examples of the liquid ejecting apparatus include, for example, a liquid ejecting apparatus that ejects liquid including materials, such as an electrode material, colorant, or the like in a dispersed or dissolved state for use in manufacturing a liquid crystal display, an electroluminescence display, a surface-emitting display, a color filter, and the like. The liquid ejecting apparatus may be an apparatus that ejects a bio-organic substance used for bio-chip manufacturing, an apparatus that ejects liquid to be a specimen used for an apparatus precision pipette, a textile printing apparatus, a micro dispenser, or the like. The liquid ejecting apparatus may be an apparatus that ejects a lubricant on a precision machinery, such as a clock, a camera, or the like in a pinpoint manner, or an apparatus that ejects, on a substrate, transparent resin liquid, such as ultraviolet curable resin, or the like for forming micro hemispherical lens for use as an optical communication element, optical lens, and the like. The liquid ejecting apparatus may be an apparatus that ejects etching solution, such as acid, alkali, or the like for etching a substrate, or the like.

Hereinafter a description will be given of the technical idea and its operational advantages that are obtained from the above-described embodiments and variations.

A liquid ejecting apparatus includes: a liquid ejecting head configured to eject liquid contained in a liquid container; a display portion configured to display information; a remaining amount detection portion configured to detect that a remaining amount of the liquid contained in the liquid container becomes less than a threshold value; and a control portion configured to control display of the display portion, in which the control portion causes the display portion to display a calculation remaining amount calculated based on an initial amount of storage of the liquid contained in the liquid container, a total discharge amount of the liquid discharged from the liquid ejecting head, and a correction amount corresponding to a use environment.

With this configuration, the control portion adds a correction amount corresponding to the use environment to the calculation remaining amount and displays the calculation remaining amount in the display portion. Accordingly, it is possible to reduce a discrepancy between the actual remaining amount of the liquid contained in the liquid container and the calculation remaining amount displayed in the display portion.

In the liquid ejecting apparatus, the control portion may change an amount of change of the calculation remaining amount per unit discharge amount in the display portion in accordance with the use environment. For example, when the amount of change per unit discharge amount is fixed, the size of the display area in which the calculation remaining amount has to be changed in accordance with the use environment. However, when the size of the display area is changed, it might give a user the impression that the initial amount of storage has changed. On that point, with this configuration the control portion changes the amount of change of the calculation remaining amount per unit discharge amount in the display portion in accordance with the use environment. Accordingly, it is possible to display the calculation remaining amount corresponding to the use environment while keeping the size of the display area for displaying the calculation remaining amount fixed.

In the liquid ejecting apparatus, the correction amount may correspond to atmospheric pressure of the use environment. For example, some of the liquid ejecting apparatuses supply the liquid contained in the liquid container to the liquid ejecting head using the pump. In some of the pumps, the suction performance for sucking the liquid from the liquid container changes in accordance with the atmospheric pressure of the use environment. On that point, with this configuration, the control portion calculates the calculation remaining amount based on the correction amount corresponding to the atmospheric pressure. Accordingly, it is possible to reduce a discrepancy between the actual remaining amount of the liquid contained in the liquid container and the calculation remaining amount displayed in the display portion.

In the liquid ejecting apparatus, the control portion may further reduce an amount of change of the calculation remaining amount per unit discharge amount in the display portion as the atmospheric pressure becomes higher.

When the atmospheric pressure of the use environment is low, the pump that supplies liquid is likely to have a lower suction performance than when the atmospheric pressure is high. That is to say, the usable liquid quantity out of the liquid contained in the liquid container tends to increase as the atmospheric pressure is high. Accordingly, by reducing the amount of change of the calculation remaining amount per unit discharge amount in the display portion as the atmospheric pressure becomes higher, it is possible to reduce a discrepancy between the actual remaining amount of the liquid contained in the liquid container and the calculation remaining amount displayed in the display portion.

In the liquid ejecting apparatus, the correction amount may correspond to temperature of the use environment.

For example, some of the liquid containers contain liquid in a flexible bag body. The bag body changes its flexibility with temperature. On that point, with this configuration, since the control portion calculates the calculation remaining amount based on the correction amount corresponding to a temperature, it is possible to reduce a discrepancy between the actual remaining amount of the liquid contained in the liquid container and the calculation remaining amount displayed in the display portion.

In the liquid ejecting apparatus, the control portion may further reduce an amount of change of the calculation remaining amount per unit discharge amount in the display portion as the temperature becomes higher. The bag body becomes more inflexible when the temperature of the use environment is lower than when the temperature is higher. That is to say, out of the liquid contained in the liquid container, the usable liquid quantity tends to increase as the temperature of the use environment is higher. Accordingly, by reducing the amount of change of the calculation remaining amount per unit discharge amount in the display portion as the temperature becomes higher, it is possible to reduce a discrepancy between the actual remaining amount of the liquid contained in the liquid container and the calculation remaining amount displayed in the display portion.

In the liquid ejecting apparatus, the control portion may change the amount of change of the calculation remaining amount per unit discharge amount in the display portion in accordance with the use environment when power is turned on.

With this configuration, the control portion changes the amount of change of the calculation remaining amount per unit discharge amount in the display portion in accordance with the use environment in the display portion at the time of turning on the power. Accordingly, it is possible to display the calculation remaining amount in accordance with the use environment at the time of using the liquid ejecting apparatus.

In the liquid ejecting apparatus, the control portion may change the amount of change of the calculation remaining amount corresponding to the unit discharge amount in the display portion in accordance with the use environment every time a predetermined time period elapses in a power-on state. With this configuration, every time a predetermined time period elapses in the power-on state, the control portion changes the amount of change of the calculation remaining amount per unit discharge amount in the display portion in accordance with the use environment. Accordingly, when the use environment has changed in a state of using the liquid ejecting apparatus, it is possible to display the calculation remaining amount to suit the use environment.

A control method of a liquid ejecting apparatus including a liquid ejecting head configured to eject liquid contained in a liquid container, a display portion configured to display a calculation remaining amount of the liquid contained in the liquid container, and a remaining amount detection portion configured to detect that a remaining amount of the liquid contained in the liquid container becomes less than a threshold value, the control method includes: changing an amount of change of the calculation remaining amount per unit discharge amount in the display portion in accordance with a use environment of the liquid ejecting apparatus.

With this method, the control portion changes the amount of change of the calculation remaining amount per unit discharge amount in the display portion in accordance with the use environment of the liquid ejecting apparatus. Accordingly, it is possible to reduce a discrepancy between the actual remaining amount of the liquid contained in the liquid container and the calculation remaining amount displayed in the display portion.

In the control method of a liquid ejecting apparatus, the amount of change may be further reduced as atmospheric pressure of the use environment becomes higher.

With this method, the amount of change of the calculation remaining amount per unit discharge amount in the display portion is further reduced as the atmospheric pressure increases. Accordingly, it is possible to reduce a discrepancy between the actual remaining amount of the liquid contained in the liquid container and the calculation remaining amount displayed in the display portion.

In the control method of a liquid ejecting apparatus, the amount of change may be further reduced as temperature of the use environment becomes higher.

With this method, the amount of change of the calculation remaining amount per unit discharge amount in the display portion is further reduced as temperature of the use environment becomes higher. Accordingly, it is possible to reduce a discrepancy between the actual remaining amount of the liquid contained in the liquid container and the calculation remaining amount displayed in the display portion.

What is claimed is:

1. A liquid ejecting apparatus comprising:

a liquid ejecting head configured to eject liquid contained in a liquid container;

a display portion configured to display information;

a remaining amount detection portion configured to detect that a remaining amount of the liquid contained in the liquid container becomes less than a threshold value; and a control portion configured to control display of the display portion, wherein the control portion causes the display portion to display a calculation remaining amount calculated based on an initial amount of storage of the liquid contained in the liquid container, a total discharge amount of the liquid discharged from the liquid ejecting head, and a correction amount corresponding to a use environment, the control portion changes an amount of change of the calculation remaining amount per unit discharge amount in the display portion in accordance with the use environment, and when the control portion cannot obtain a temperature of the use environment, the control portion calculates the amount of change of the calculation remaining amount based on an assumed minimum temperature.

2. The liquid ejecting apparatus according to claim 1, wherein the correction amount corresponds to atmospheric pressure of the use environment.

3. The liquid ejecting apparatus according to claim 2, wherein the control portion further reduces an amount of change of the calculation remaining amount per unit discharge amount in the display portion as the atmospheric pressure becomes higher.

4. The liquid ejecting apparatus according to claim 1, wherein the correction amount corresponds to temperature of the use environment.

5. The liquid ejecting apparatus according to claim 4, wherein the control portion further reduces an amount of change of the calculation remaining amount per unit discharge amount in the display portion as the temperature becomes higher.

6. The liquid ejecting apparatus according to claim 2, wherein the control portion changes the amount of change of the calculation remaining amount per unit discharge amount in the display portion in accordance with the use environment when power is turned on.

7. The liquid ejecting apparatus according to claim 2, wherein the control portion changes the amount of change of the calculation remaining amount per unit discharge amount in the display portion in accordance with the use environment every time a predetermined time period elapses in a power-on state.

8. The liquid ejecting apparatus according to claim 1, wherein when the control portion cannot obtain an atmospheric pressure of the use environment, the control portion calculates the amount of change and the calculation remaining amount based on an assumed minimum atmospheric pressure.

9. A liquid ejecting apparatus comprising:

a liquid ejecting head configured to eject liquid contained in a liquid container;

a display portion configured to display information;

a remaining amount detection portion configured to detect that a remaining amount of the liquid contained in the liquid container becomes less than a threshold value; and a control portion configured to control display of the display portion, wherein the control portion causes the display portion to display a calculation remaining amount calculated based on an initial amount of storage of the liquid contained in the liquid container, a total discharge amount of the liquid discharged from the liquid ejecting head, and a correction amount corresponding to a use environment, wherein the calculation remaining amount satisfies the expression:

(an initial amount of storage of the liquid contained in the liquid container−a total discharge amount of the liquid discharged from the liquid ejecting head)×(an amount of change of the calculation remaining amount per unit discharge amount) (1), and the amount of change of the calculation remaining amount per unit discharge amount satisfies the expression:

(a unit discharge amount)/(a reference amount+the correction amount)×100 (2), where the reference amount is based on (the initial amount of storage of the liquid)−(a maximum unusable amount of liquid).

* * * * *